US009233820B2

(12) United States Patent
Bernhard

(10) Patent No.: US 9,233,820 B2
(45) Date of Patent: Jan. 12, 2016

(54) ROTATABLE BOTTLE OR CONTAINER CAPPING MACHINE FOR SCREWING THREADED SCREW CAPS ONTO A THREADED MOUTH PORTION OF FILLED BOTTLES OR CONTAINERS TO CLOSE FILLED BOTTLES OR CONTAINERS, AND A METHOD OF OPERATION THEREOF

(75) Inventor: Herbert Bernhard, Wolfsheim (DE)

(73) Assignee: KHS GmbH, Dortmund (DE)

( * ) Notice: Subject to any disclaimer, the term of this patent is extended or adjusted under 35 U.S.C. 154(b) by 822 days.

(21) Appl. No.: 12/492,266

(22) Filed: Jun. 26, 2009

(65) Prior Publication Data

US 2010/0154364 A1 Jun. 24, 2010

Related U.S. Application Data

(63) Continuation of application No. 10/982,694, filed on Nov. 5, 2004, now abandoned.

(30) Foreign Application Priority Data

Nov. 7, 2003 (DE) ..... 103 52 016

(51) Int. Cl.
*B67B 1/06* (2006.01)
*B67B 3/20* (2006.01)

(52) U.S. Cl.
CPC ..... *B67B 3/2033* (2013.01); *B67B 2201/08* (2013.01)

(58) Field of Classification Search
USPC ..... 53/253, 317, 331.5, 319, 490
See application file for complete search history.

(56) References Cited

U.S. PATENT DOCUMENTS 2,076,631 A 4/1937 Gantzer
2,987,313 A 6/1961 Bjering et al.

(Continued)

FOREIGN PATENT DOCUMENTS

DE 31 04 187 8/1982
DE 288 815 4/1991

(Continued)

OTHER PUBLICATIONS

European Search Report EP 04 02 0830 and English translation thereof.

(Continued)

*Primary Examiner* — Sameh Tawfik
(74) *Attorney, Agent, or Firm* — Nils H. Ljungman & Associates

(57) ABSTRACT

Rotatable bottle or container capping machine for screwing threaded screw caps onto a threaded mouth portion of filled bottles or containers to close filled bottles or containers, and a method of operation thereof. The abstract of the disclosure is submitted herewith as required by 37 C.F.R. §1.72(b). As stated in 37 C.F.R. §1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

15 Claims, 15 Drawing Sheets

SECTION A-A
IN FIG. 6

(56) References Cited

U.S. PATENT DOCUMENTS

| | | | | |
|---|---|---|---|---|
| 4,007,342 | A | 2/1977 | Makino et al. | |
| 4,089,153 | A | 5/1978 | Long | |
| 4,506,811 | A | 3/1985 | Miksitz | |
| 4,608,806 | A | 9/1986 | Haslam et al. | |
| 5,074,104 | A | 12/1991 | Desjonqueres et al. | |
| 5,713,403 | A * | 2/1998 | Clusserath et al. | 141/101 |
| 5,893,259 | A * | 4/1999 | Posge | 53/448 |
| 5,934,042 | A | 8/1999 | Peronek | |
| 7,024,837 | B2 | 4/2006 | Takebe et al. | |
| 7,048,268 | B2 | 5/2006 | Arai et al. | |

FOREIGN PATENT DOCUMENTS

| | | |
|---|---|---|
| DE | G 91 02 659.8 | 5/1991 |
| DE | 42 17 461 | 12/1993 |
| DE | G 93 03 698.1 | 4/1994 |
| DE | 295 05 567 | 4/1996 |
| DE | 200 19 305 | 6/2001 |
| DE | 100 56 990 | 5/2002 |
| DE | 202 18 380 | 2/2003 |
| DE | 202 18 523 | 3/2003 |
| EP | 0 521 581 | 1/1993 |
| EP | 0 690 020 | 1/1996 |
| EP | 0 758 624 | 2/1997 |
| EP | 1 205 430 | 5/2002 |
| GB | 559 269 | 2/1944 |
| JP | 55133297 | 10/1980 |
| JP | 57055792 U | 4/1982 |
| JP | 59084788 A | 5/1984 |
| JP | 63258794 A | 10/1988 |
| JP | 09039921 A | 2/1997 |
| JP | 11043195 A | 2/1999 |
| JP | 2001-039491 A | 2/2001 |
| JP | 2001-039492 A | 2/2001 |
| JP | 2001-122390 A | 5/2001 |
| JP | 2002308380 A | 10/2002 |
| JP | 2003163478 A | 6/2003 |
| JP | 2003317516 A | 11/2003 |
| RU | 209 6312 | 11/1997 |
| SU | 175 1154 | 7/1992 |

OTHER PUBLICATIONS

Japanese Search Report 2004-303654.

* cited by examiner

SECTION A-A IN FIG. 6

SECTION B-B
IN FIG. 6

FIG. 7
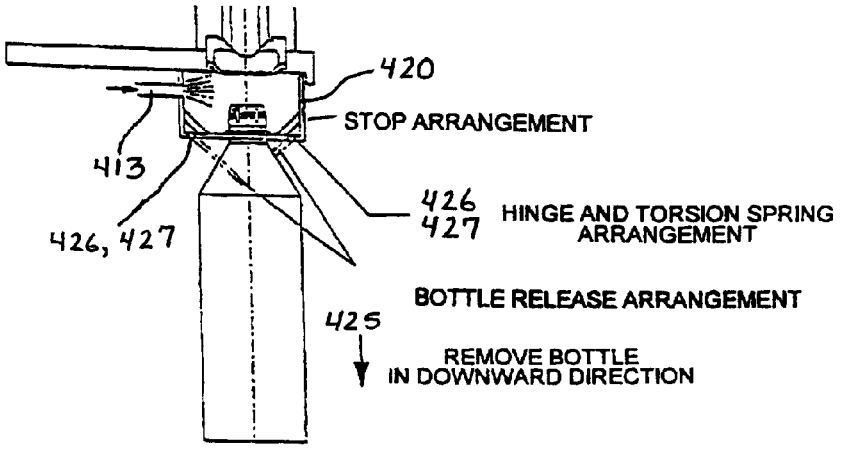
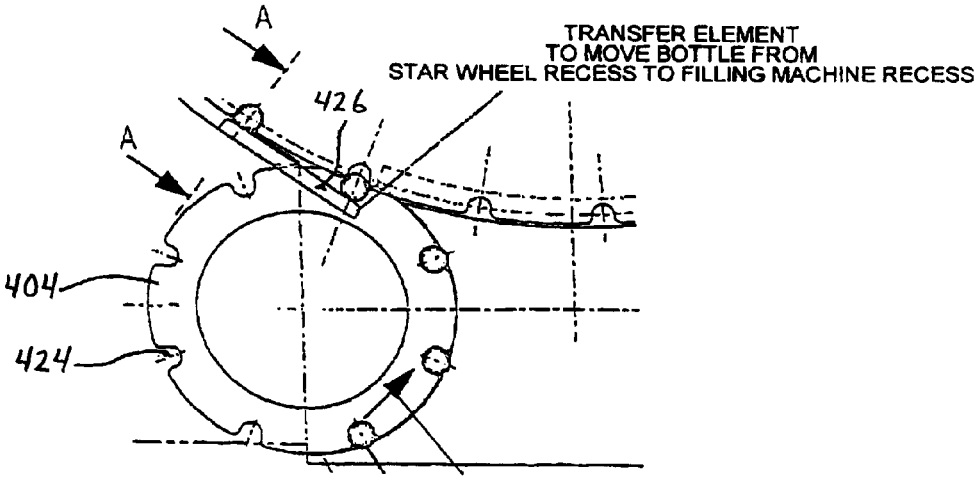
FIG. 8

SECTION A-A IN FIG. 8

ROTATABLE BOTTLE OR CONTAINER CAPPING MACHINE FOR SCREWING THREADED SCREW CAPS ONTO A THREADED MOUTH PORTION OF FILLED BOTTLES OR CONTAINERS TO CLOSE FILLED BOTTLES OR CONTAINERS, AND A METHOD OF OPERATION THEREOF

BACKGROUND

1. Technical Field

The present application relates to a beverage bottling plant for filling bottles with a liquid beverage filling material, having a closing machine and a method for closing bottles, as described herein below.

2. Background Information

A beverage bottling plant for filling bottles with a liquid beverage filling material can possibly comprise a beverage filling machine with a plurality of beverage filling positions, each beverage filling position having a beverage filling device for filling bottles with liquid beverage filling material. The filling devices may have an apparatus designed to introduce a predetermined volume of liquid beverage filling material into the interior of bottles to a substantially predetermined level of liquid beverage filling material. The apparatus designed to introduce a predetermined flow of liquid beverage filling material further comprises an apparatus that is designed to terminate the filling of the beverage bottles upon the liquid beverage filling material reaching the predetermined level in bottles. There may also be provided a conveyer arrangement that is designed to move bottles, for example, from an inspecting machine to the filling machine. Upon filling, a closing station closes the filled bottles. There may further be provided a conveyer arrangement configured to transfer filled bottles from the filling machine to the closing station. Bottles may be labeled in a labeling station, the labeling station having a conveyer arrangement to receive bottles and to output bottles. The closing station and the labeling station may be connected by a corresponding conveyer arrangement.

Closing machines, in particular those with a rotating construction, for the closing of containers such as bottles, for example, with caps by screwing them into place are basically known (U.S. Pat. No. 2,076,631). The caps used in these machines can be made of metal (e.g. aluminum) for example, but they can also be made of plastic. These caps that are made of plastic are prefabricated with an internal screw thread with which they are screwed onto the external screw thread of the bottle which is provided on the mouth of the bottle for the closing, and they are tightened with a specified torque.

One construction that has become particularly common is one in which a plurality of screw-on units are provided in a rotating circulating rotor, the shaft of which screw-on units is rotated in realizations of the prior art by a pinion that sits on the shaft, which pinion runs along on a toothed rim that is installed non-rotationally on the stator. For its part, the shaft rotates the screw head, into which the cap has previously been fed in the conventional gripping engagement. As the rotor rotates, the screw-on units are moved downward one after another by their level control system toward the bottles below them and thereby screw the cap onto the bottle.

U.S. Pat. No. 2,987,313 and EP 0521581 A1 disclose that each screwing unit can be provided with its own drive motor, the shaft of which is oriented axially parallel to the shaft of the screwing unit and is coupled to the screwing unit by a transmission. One disadvantage of such an apparatus is the complexity of the design and the resulting expense for the transmission coupling and the additional bearing points that must rotate with the apparatus, whereby the entire screwing unit still has to be moved toward the bottle.

In similar devices of the prior art, attempts have been made, by providing a small outside diameter of the screwing device, to increase the speed of rotation of the screw head independently of the speed of rotation of the rotor, to increase the throughput. In this regard, it is known that the shaft can be provided with a translation gearing between the toothed rim and the pinion which increases the speed of rotation. For construction reasons, given the extremely small amount of space available for the installation of the screw-on units in a screw-on device, however, this arrangement entails significant design problems. A similar construction is illustrated in EP0 690 020 A1. In this design, however, for the reasons disclosed in the patent, the gearing results in an undesirable reduction in the speed of rotation of the screw head. An additional similar construction is illustrated in DE 91 02 659 U1. In this construction, two gear sets are optionally engaged for different screwing depths, which results in a very complex construction.

Finally, the prior art also describes a device for the capping of bottles or similar containers with closing or screw caps that has a plurality of capping positions formed on the periphery of a rotor that rotates around a vertical machine shaft, to which positions the containers to be closed are transferred at a container inlet, and the closed containers are removed at a container outlet. Each closing position has a container carrier and a screw spindle that is provided on its lower end with a screw head and is mounted so that it can rotate around a container or spindle axis, which can be driven in rotation around its spindle axis by a drive, whereby the drive of the screw spindles can be adjusted or controlled in terms of the torque that is transmitted to the screw head and/or the speed of rotation of the screw heads.

The prior art also describes a similar device of the type disclosed in DE 20218523. In this device, special emphasis is placed on an exposed construction which is easy to clean, because the planned area of application of this closing machine is cold aseptic bottling.

To reduce the number of components and assemblies required and the resulting surface area, gaps, undercuts and slots to be cleaned, in this device, the capping heads are realized so that they are quasi-stationary vertically, and associated with each of these closing heads is a drive motor which drives the capping head directly, i.e. without additional gearing.

The bottles to be capped are thereby moved from a lower inlet position into an upper closing position, and are then moved into a lower discharge position.

With the teaching of DE 202 18 523, great progress was achieved with regard to the time and effort involved in cleaning, as well as in the safety and reliability of the process, in particular with regard to aseptic bottling, although further tests and analyses have demonstrated that there is additional potential for improvement.

With an increased demand for quality of the beverage to be filled into containers and its stability of durability, there is at hand a type of arrangement in which the handling positions are disposed in a closed space that is supplied with a special atmosphere. Such a space can be supplied with an inert atmosphere, for example, carbon dioxide, with a sterilizing atmosphere, or with hydrogen peroxide and thus can ensure a treatment of the beverage that is low in oxygen and low in germs, this being of paramount importance for the filling quality of the beverage. Such handling machines are known in many varieties in the beverage industry.

German Patent No. DE-PS 696,569 shows an arrangement in which a filling machine is disposed in a closed housing. The space that is provided in this manner is determined by the full size of the machine and has a substantial volume. German Patent Publication No. DE-OS 199 11 517 A1 shows a rotating filling machine that is fully disposed in a tightly surrounding housing that has a size that is determined by the size of the machine and, accordingly, the housing is also of substantial volume. German Patent No. DE-PS 198 35 369 C1 shows an embodiment in which the lower handling positions of container handling machines extend in sealed manner from above into a space that is supplied with a special atmosphere. This space is equipped so as to be accessed from below.

A further solution is disclosed in German Patent Publication No. DE-OS 197 31 796. The technical embodiment of this reference comprises a filling machine and a closing machine that are both disposed in a clean space or room that has a volume that is dimensioned so as to be so tight such that there is only space for maintenance at the filling machine and at the closing machine. By way of the reduction of the volume of the clean space, a lowering of the operating expense of the arrangement is to be attained. In addition, an immersion bath sterilizer is directly disposed at the clean space. This measure is to achieve, in contrast with European Patent No. EP 0120 789, to make the second rinser superfluous and to obviate associated operating and capital expenditures. This solution comprises overall the drawback that also in this embodiment there is suggested a clean space that fully envelops the filling machine, as well as the closing machine, and this arrangement requires a large amount of space and high construction and operating expenses. The desired extensive reduction in size of the constructive volume of the clean space that is sought in this teaching entails marked disadvantages, due to the diminished accessibility when maintenance is to be carried out.

The substantial volume of the space that is supplied with a special atmosphere is, accordingly, of disadvantage in the designs of the prior art. In the event of disruptions of operations, the space needs to be opened. It is then filled with normal ambient air and is correspondingly accessible to germs. The subsequent cleaning of the space prior to resumption of operations is largely determined by the surfaces and the overall volume of the space. In the case of the known large clean rooms, accordingly, the interruptions of operations, that are necessary due to disruptions of operations, or required relocation of machines, as well as the unavoidable cleaning of machines, last for hours.

From German Patent Publication No. DE-OS 101 45 803 A1 (corresponding to International Patent Publication No. WO 03/024860 A1, published on Mar. 27, 2003) and German Petty Patent No. DE-GM 297 13 155 U1, (corresponding to U.S. Pat. No. 6,026,867 issued to Karl on Feb. 22, 2000), it is finally known that the closed space is configured as an annular tunnel structure that moves about/or surrounds the carousel of the filling machine and the annular boiler, on the one hand, and by the stationary surfaces, on the other hand, whereby the carousel surfaces and the stationary surfaces are disposed in sealing manner atop one another or, respectively, with respect to one another by way of concentric seal elements. These known configurations already substantially reduce the required clean space.

Object or Objects

The object of the present application is to realize a closing machine in which the cleaning of the machines and equipment and the safety and reliability of the process are further improved, in particular but not exclusively for cold aseptic bottling and closing. For this purpose, the present application teaches further optimizations of the number, the amount of surface area, and the structure of the external surfaces of a closing machine.

The present application teaches that the object stated above can be accomplished by the features disclosed herein below.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The embodiments are explained in greater detail below on the basis of the accompanying figures, which illustrate at least one possible embodiment, in which:

FIG. 7 illustrates a bottle unload arrangement for special cases that are caused by disruptions, along line A-A in FIG. 6;

FIG. 8 illustrates a transfer arrangement for transferring bottles from the input star conveyer to the filling machine.

DESCRIPTION OF EMBODIMENT OR EMBODIMENTS

Figure 1:
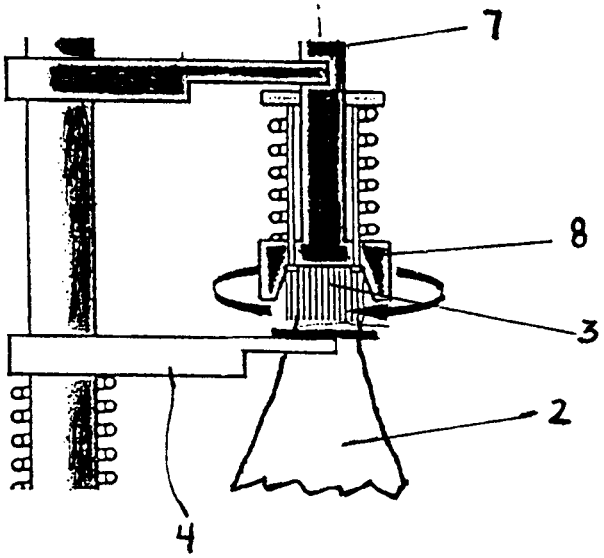
FIG. 1 is a simplified illustration in partial section of a screw head for screwing on screw caps.

Developments, advantages and potential applications of the embodiments are discussed in the following description of exemplary embodiments and of the accompanying drawings. All the features described herein and/or illustrated in the drawings form the object of the present application individually or in any possible combination.

Figure 1A:
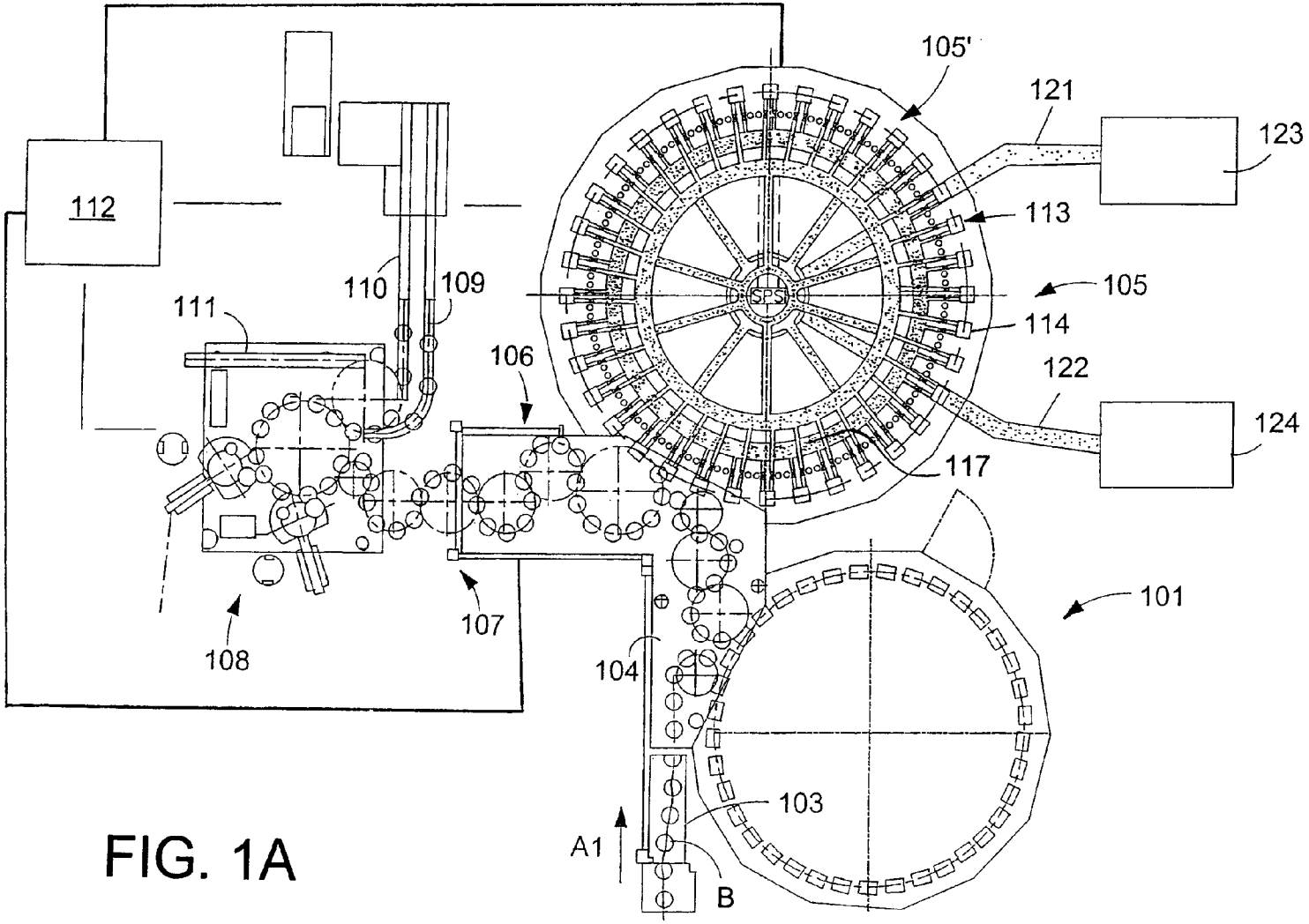
FIG. 1A is a schematic illustration of a container filling plant in accordance with one possible embodiment.

FIG. 1A shows schematically the main components of one embodiment example of a system for filling containers, specifically, an embodiment of a beverage bottling plant 100 for filling bottles B with liquid beverage filling material, in accordance with one embodiment, or in which system or plant could possibly be utilized at least one aspect, or several an aspects, of the embodiments disclosed herein.

FIG. 1A shows a rinsing arrangement or rinsing station 101, to which the containers, namely bottles B, are fed in the direction of travel as is indicated by the arrow A1, by means of a conveyer line or conveyer arrangement to feed bottles to rinsing arrangement 103, and downstream of rinsing arrangement or rinsing station 101, in the direction of travel as is indicated by the arrow A1, the rinsed bottles B are transported to a beverage filling machine 105 by means of a conveyer line or conveyer arrangement 104 to pass bottles to filling machine that is formed, for example, by a starwheel conveyer or a plurality of starwheels of a conveyer arrangement. The conveyer arrangement 104 to pass bottles to filling machine may possibly comprise a starwheel conveying structure that introduces bottles B to the filling machine 105.

Downstream of the filling machine 105, in the direction of travel of the bottles B, there can preferably be a closing arrangement or closing station 106 which closes the bottles B.

The closing arrangement or closing station 106 can, for example, be connected directly to a labeling arrangement or labeling station 108 having at least one labeling unit, device, or module for first product, each unit having a head, such as, for example, by means of a conveyer arrangement 107 to pass bottles to labeling arrangement that may be formed, for example, by a plurality of starwheels of a conveyer arrangement.

In the illustrated embodiment, the labeling arrangement or labeling station 108 having at least one labeling unit, device, or module for first product, each unit having a head has, for example, three outputs, namely one output formed by a conveyer arrangement 109 to convey first product bottles for bottles B that are filled with a first product. The first product may possibly be provided by a first product mixer 123 that is connected to the filling machine 105, for example, through a conduit for first product 121, and bottles B that are filled with a predetermined volume of liquid beverage filling material, that is, the first product, are then labeled by a labeling module in the labeling arrangement or labeling station 108 having at least one labeling unit, device, or module for first product, each unit having a head, corresponding to this first product delivered from first product mixer 123 to the beverage filling machine 105 and thence to the corresponding bottles B.

A second output that is formed by a conveyer arrangement 110 to convey second product bottles is provided for those bottles B that are filled with a second product. The second product may emanate from a second product mixer 124 that is connected, for example, through a conduit for second product 122 to the filling machine 105, and these bottles B filled with a predetermined volume of liquid beverage filling material comprising the second product are then correspondingly labeled by a labeling module in the labeling arrangement or labeling station 108 having at least one labeling unit, device, or module for first product, each unit having a head, corresponding to this second product.

A third output, for example, formed by a conveyer arrangement 111 to convey incorrectly labeled bottles, removes any bottles B which have been incorrectly labeled as may have been determined by an inspecting device or an inspecting station, or an inspecting module 128 that may possibly form a part of the labeling arrangement or labeling station 108 having at least one labeling unit, device, or module for first product, each unit having a head.

In FIG. 1A item 112 is a central control arrangement or, expressed differently, a controller with a computer to process algorithms, which controls the operation of the above-referenced system or plant.

The beverage filling machine 105 is preferably of the revolving design, with a rotor 105', which revolves around a vertical machine axis. The rotor 105' is designed to handle the bottles B by the neck. A filling arrangement 114 having at least one filling device, element, apparatus, or valve, comprises an apparatus configured to introduce a predetermined volume of liquid beverage filling material into the interior of bottles B to a predetermined level of liquid beverage filling material. Furthermore, the filling device or apparatus comprises an apparatus configured to terminate the filling of bottles upon liquid beverage filling material reaching the predetermined level in bottles B. In other words, the filling arrangements 114 having at least one filling device, element, apparatus, or valve, are configured and disposed to provide a predetermined flow of liquid beverage filling material from the source thereof, such as, product mixers 123 and 124, into the bottles B.

The toroidal vessel 117 is a component, for example, of the revolving rotor 105'. The toroidal vessel 117 can be connected by means of a rotary coupling or a coupling that permits rotation, and by means of the conduit for first product 121 to the external reservoir or first product mixer 123 to supply the product.

As well as the more typical filling machines having one toroidal vessel, it is possible that in at least one possible embodiment a filling machine could possibly be utilized wherein each filling arrangement 114 having at least one filling device, element, apparatus, or valve is preferably connected by means of two connections to a toroidal vessel 117 which contains a first product, say by means of a first connection, for example, the conduit for first product 121, and to a second toroidal vessel which contains a second product, say by means of the second connection, for example, the conduit for second product 122. In this case, each filling arrangement 114 having at least one filling device, element, apparatus, or valve can also preferably have, at the connections, two individually-controllable fluid or control valves, so that in each bottle B which is delivered at the inlet of the filling machine 105 to a filling position 113, the first product or the second product can be filled by means of an appropriate control of the filling product or fluid valves.

It will be understood that while a two-product assembly or system of a bottling plant is illustrated in FIG. 1A, the disclosure is equally applicable to single-product installations, or other commensurate embodiments.

Figure 1B:
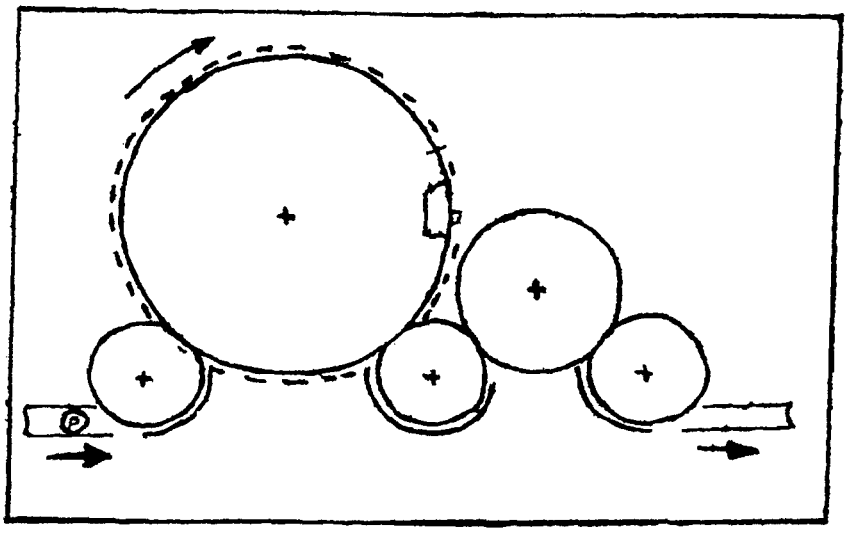
FIG. 1B shows a possible embodiment of a container handling machine with an aseptic filling system or a clean room, which aseptic filling system or clean room is represented by a box around the container handling machine.

FIG. 1B shows a possible embodiment of a container handling machine with an aseptic filling system or a clean room, which aseptic filling system or clean room is represented by a box around the container handling machine. In this possible embodiment, the aseptic filling system may encompass the entire container handling machine, or more than just the tops of the bottles.

The device which is illustrated in FIG. 1 is designated 1 in general, and is used for the closing of containers 2, such as bottles or canisters, for example, with caps or screw caps 3 which are made of a suitable material, such as metal or aluminum for example, or plastic, and have a prefabricated internal thread with which they can be screwed onto the external thread provided in the vicinity of the bottle month to close or cap a container 2.

For closing, the containers 2 which are standing vertically upright are transferred one after the other by a conveyor (not shown) by means of an inlet star wheel that forms the container inlet for the closing machine 1, to one of the closing positions which are located on the periphery of the rotor that is driven so that it rotates around a vertical machine axis, and specifically so that said positions are distributed at uniform angular intervals around the axis. The closed containers 2 are removed from the closing positions by means of an outlet star wheel and are carried away by a conveyor (not shown).

In each closing position there is a container or bottle carrier or bottle holder 4 to receive and hold a container 2 which is oriented with its vertical axis parallel or approximately parallel to the axis of rotation of the closing machine 1.

Associated with each closing position, above the bottle holder, is a separate screw shaft set 6, which among other things has a screw shaft 7 that lies parallel with its vertical axis parallel to the axis of rotation of the closing machine 1, with a screw head 8 on the bottom.

During the circulation of the closing machine 1, each container 2 and thus also the respective bottle holder 4 executes a controlled vertical reciprocating movement, a screw cap 3 is received by each screw head 8 in a transfer position (not shown), and then the mouth of the container is moved toward the screw cap 3, where the cap is screwed on by rotating the screw shaft 7 around its vertical axis and is then tightened with a specified torque.

For the execution of the rotational movement of the screw shaft set 6, associated with each of these sets is a drive motor 5 which can be automatically separately controlled in terms of its speed of rotation, direction of rotation and torque. The drive motor 5 can be, for example, a servo motor, a stepper motor or also a synchronous motor etc., whereby all these types of motors have in common the fact that depending on the manner in which they are actuated, which can be either individually by one computer for each drive motor 5 or also by one computer in common for all the drive motors 5, they can all be automatically electrically controlled with regard to the speed of rotation, direction of rotation, torque and total angle of rotation for each individual cap screw-on process etc.

The main column 9 of the closing machine 1 holds the closing device, which is located on a reference circle, either on a rotor plate 10 or on open holder arms that are arranged in the shape of a star. The closing devices and the rotor plate 10 are thereby essentially free of installed components and/or interruptions in the surface and are realized so that they are as exposed as technically possible, to create optimum accessibility for all the parts of the machine, in particular for optimal cleaning and disinfecting activities.

With regard to the particularly advantageous configuration of the screw shaft set 6, the screw shaft 7 and the screw head 8 and other components, reference is once again made to DE 202 18 523.

For the further optimization of closing machines with respect to the cleaning, safety and reliability of the bottling process, the present application also teaches that components that are likely to become dirty, such as the drive motors 5, for example, which in similar systems of the prior art are freely accessible and therefore require a great deal of time and effort to clean, are encapsulated.

Figure 2:
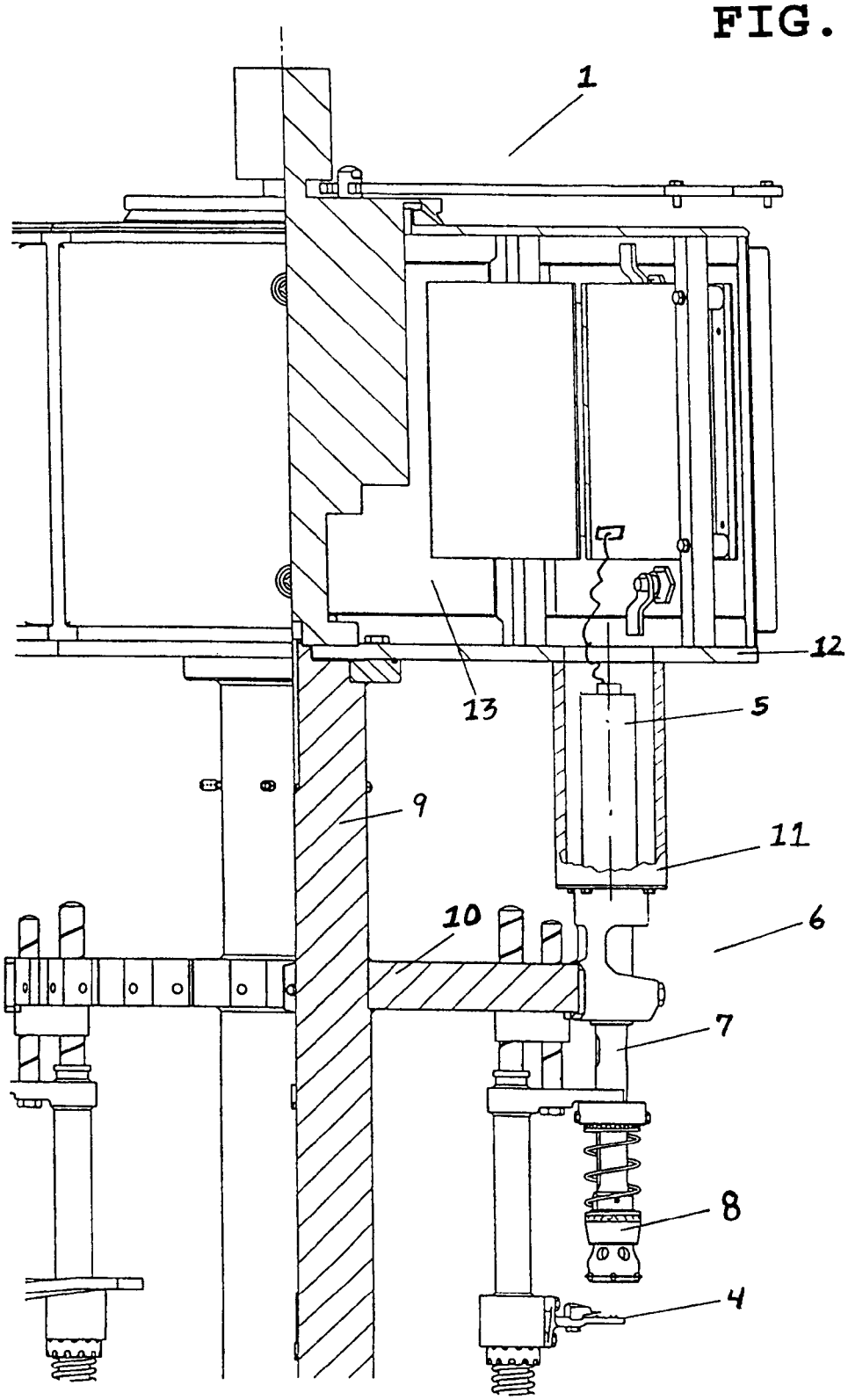
FIG. 2 is a simplified illustration in partial section of a closing machine according to the present application with mounting space.

As illustrated in FIG. 2, the present application teaches that each drive motor 5 is surrounded with a motor housing 11 which hermetically protects the drive motor 5 from all environmental influences such as unwanted intakes of air, spills, sprays, disinfecting agents or cleaning agents, for example.

The motor housing 11 emerges with its upper, open side fitting tightly into a corresponding opening of the carrier plate 12 which is located (non-rotationally) on the rotating main column 9. By means of suitable design and construction measures such as, for example, the installation of sealing and fastening elements, the connection between the motor housing 11 and the carrier plate 12 is also hermetically sealed against environmental factors. As a result of the location and orientation of side walls, roof elements, doors, seals and other elements on the carrier plate 12, a mounting space 13 that rotates together with the main column 9 is formed, which space 13 holds other means and is also hermetically sealed.

Through the above mentioned openings in the carrier plate 12 there is direct communication between the mounting space 13 and the drive motors 5 which are also protected against environmental factors by the motor housings 11. The lines that connect the drive motors 5 to the mounting space 13 are routed through these direct connections.

In an additional realization of an embodiment, to improve the ease of installation and to reduce down times in the event of a failure or malfunction, the present application teaches that these connecting lines are realized, at least on the motor side, in the form of quick-disconnect plug-in connections.

In a likewise advantageous development of an embodiment, the actuator components that belong to each individual drive motor 5 and/or to all the drive motors 5 in common, such as, for example, actuator boards, network components, rotary position transducers, torque meters, rotary distributors for operating current and/or control signals etc., are also located inside the mounting space 13, so that they are also protected and at the same time no longer need to be subjected to the conventional cleaning procedures.

For the electrical connections between the rotary distributors for the operating current and/or control signals and the respective downstream components such as the control boards or network parts, for example, the present application teaches that the required electrical connections can be made by means of plug-in connections. The particular advantage of plug-in line connections lies in their ease of maintenance and repair, which reduces the down time of the machine during interruptions in production.

To further improve the cleaning of a closing machine 1 of this type and to reduce the down time that is required for the cleaning of the machine, the present application also teaches that all of the exterior surfaces of the mounting space can be sprayed off and cleaned by stationary nozzles and/or by nozzles that rotate with the main column. For this purpose, the present application also teaches that the rotary distributors which are absolutely necessary in any case to supply the circulating spray nozzles with the required cleaning and disinfecting agents are likewise located in and/or on the mounting space 13.

The present application also teaches a particularly advantageous method for the operation of the drive motors 5. On closing machines of the prior art, regardless of the type of drive of the screw heads 8, it is conventional to keep these screw heads 8 in permanent rotation and therefore to maintain this rotation even if the screw heads 8 are momentarily not screwing any screw caps 3 onto the containers 2. This is the case, for example, when the process of screwing on a screw cap 3 has just ended and the screw head 8 is on the way to the receiving position to receive the next screw cap 3. However, this situation also occurs during the startup of a beverage bottling plant, if the containers entering the bottling plant have not yet reached the closing machine 1, although the closing machine is already running at the proper spacing.

The unnecessary rotation of the screw heads 8 is a major disadvantage, in particular during cold aseptic sterile bottling, because the permanently rotating screw heads 8 can spray large quantities of fluids and/or can stir up major quantities of dust, which can at least contaminate the closing machine 1 and thus entail an increased amount of cleaning. To eliminate these disadvantages, the present application teaches that the screw heads 8 are made to rotate only when this rotational movement is absolutely essential to screw on the screw caps 8. The present application teaches that the screw heads 8 rotate only when containers 2 are in position for capping and when the screw heads 8 are actually participating in the screwing-on process itself. These occasions include, in addition to the actual screwing-on of the cap, at least the preceding acceleration phase and the subsequent deceleration phase of the rotational movement.

With regard to the non-continuous rotation of the screw heads 8, the scope of this embodiment includes not only the exemplary embodiment described and illustrated here, in which the screw heads 8 are each driven by their own drive motor 5, whereby the motors in question can be servo motors, stepper motors or synchronous motors, but also variant embodiments that are not explicitly described or illustrated here, in which the screw heads 8 are driven by, for example, the rolling of a pinion that is effectively connected with the screw head 8 on a stationary or non-rotational internal gearing.

In an additional configuration of this embodiment, to take advantage of the possibilities that are made available by the use of a separate drive motor 5 for each screw head 8, whereby the drive motors 5 can be automatically controlled servo motors, stepper motors or synchronous motors, in which the direction or rotation of these drive motors 5 can be at least briefly reversed;

Containers 2 of the prior art generally have a right-hand thread, onto which the nut, in this case the screw cap 3, is screwed in the clockwise direction, when the operation is viewed from above. The reversal of the direction of rotation consequently means that the screw head 8 is screwed on in the counterclockwise direction, likewise looking at the operation from above.

Threading errors, which can result, for example, when the container thread and the thread of the screw cap 3 are not positioned optimally with respect to each other at the beginning of the process of screwing on the cap, can be reliably prevented by this procedure, because the two threads to be screwed into each another can be positioned with respect to each other by this reverse, counterclockwise rotation so that they can be correctly screwed into each other.

This brief reverse rotation is of particular advantage in particular for twist-off screw caps in which the thread of the screw caps 3 is not completely realized, but consists only of small guide elements that are located on the bottom-most edge of the screw caps 3.

Figure 2A:
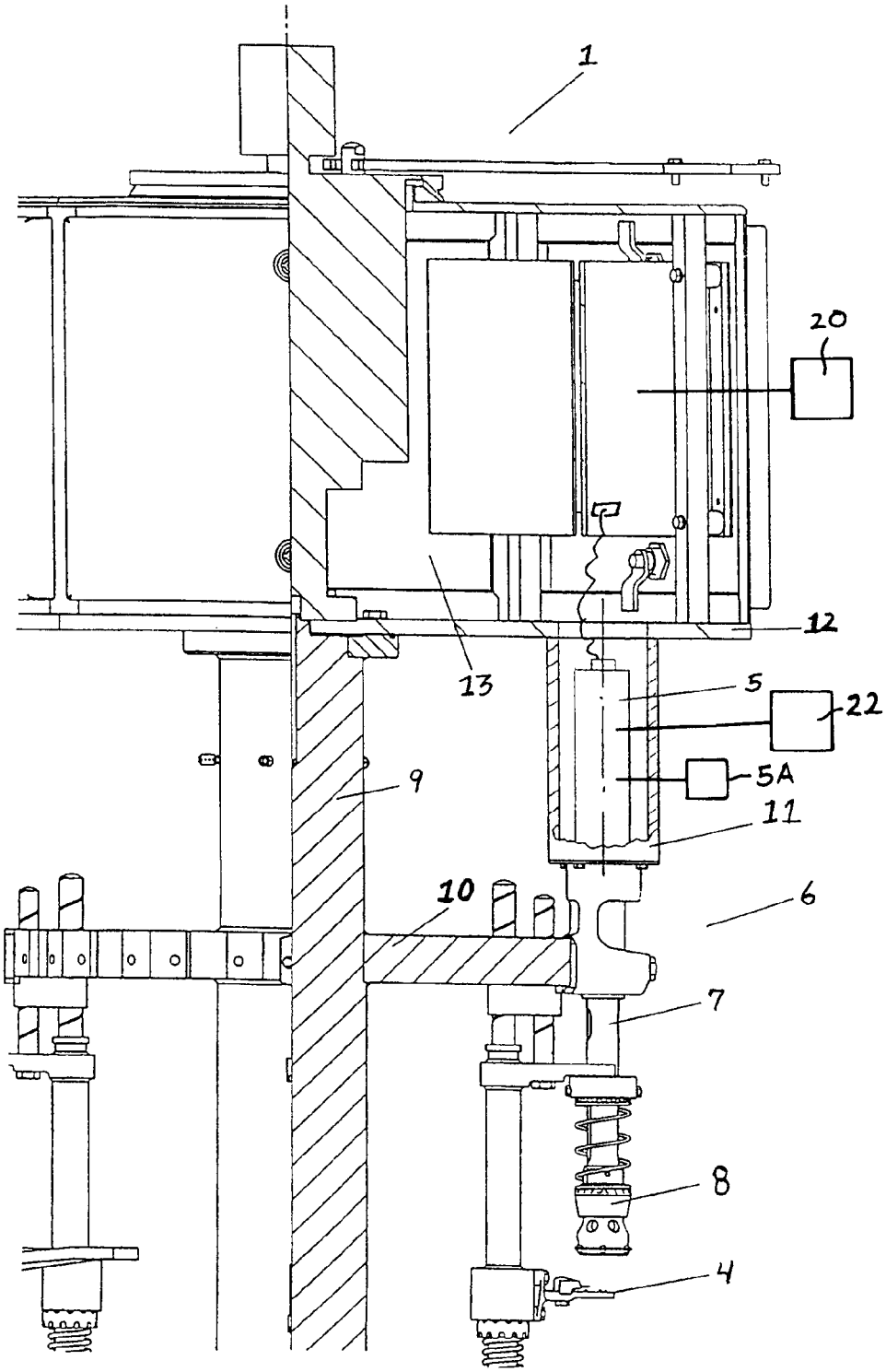
FIG. 2A is similar to FIG. 2, and shows further detail relating to one possible embodiment.

FIG. 2A is similar to FIG. 2, and shows further detail relating to one possible embodiment. In FIG. 2A, a box represents a sensor system 20, which sensor system 20 may be the means to effect a non-continuous rotation of the screw heads 8 of the closing machine. In other words, the sensor system 20 can control the starting and stopping of the rotation of the screw heads 8. For example, the sensor system 20 can monitor and control the rotation of one or more of the screw heads 8, and can stop the rotation of the screw heads 8 once the screw caps 3 reach a predetermined tightness around the mouths of containers 2. FIG. 2A also shows a rotary distributor 22 for providing operating current and/or control signals. FIG. 2A further shows a clutch 5A, which clutch 5A is another control means that effects a non-continuous rotation of the screw heads 8.

Figure 2B:
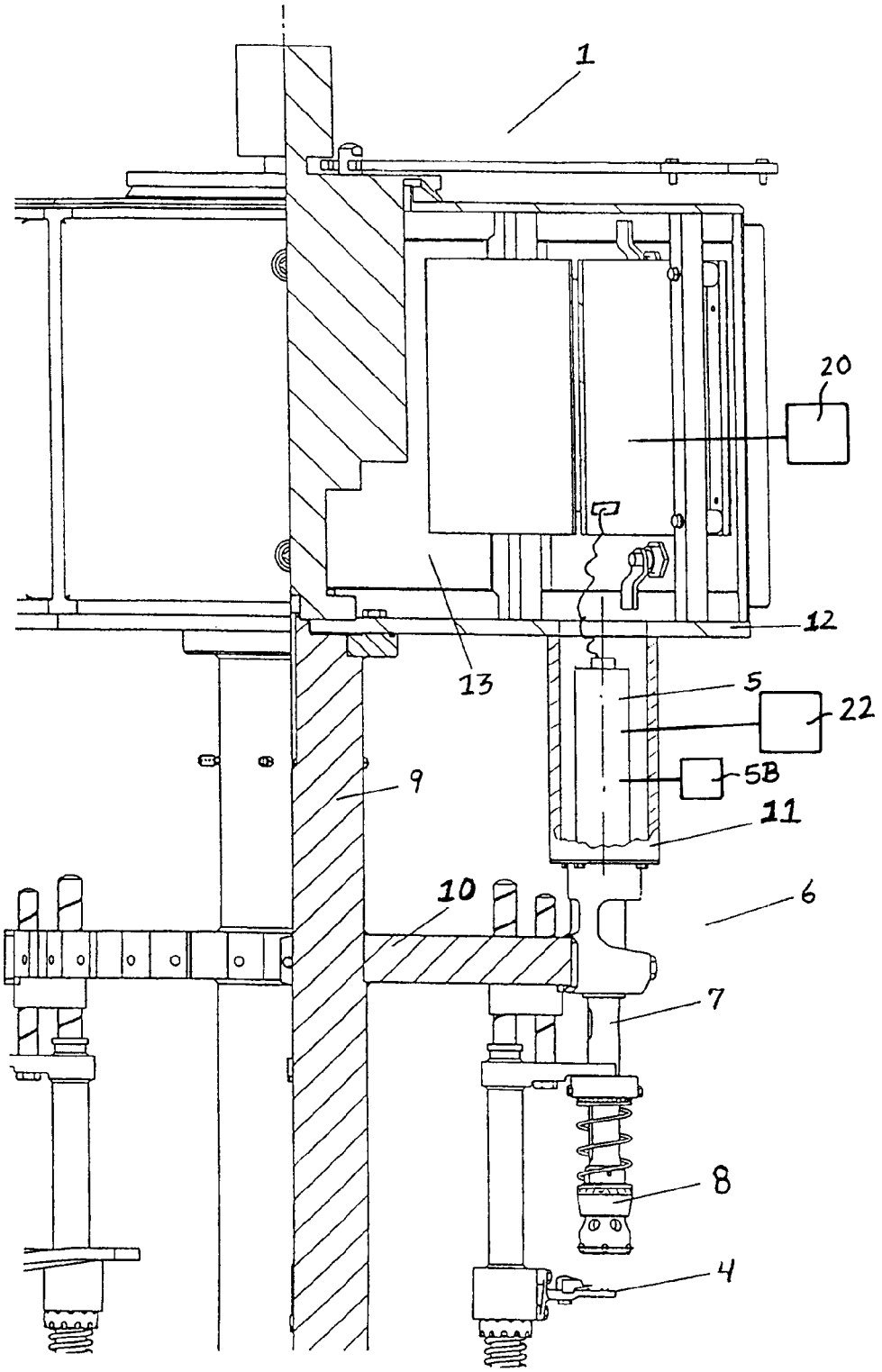
FIG. 2B is similar to FIG. 2A, and shows an alternate embodiment where means that effect a non-continuous rotation of the screw heads may be non-rotating partial segments of an internal toothing, which means are indicated by a box.

FIG. 2B is similar to FIG. 2A, and shows an alternate embodiment where means that effect a non-continuous rotation of the screw heads may be non-rotating partial segments of an internal toothing, which means are indicated by a box 5B.

Figure 3:
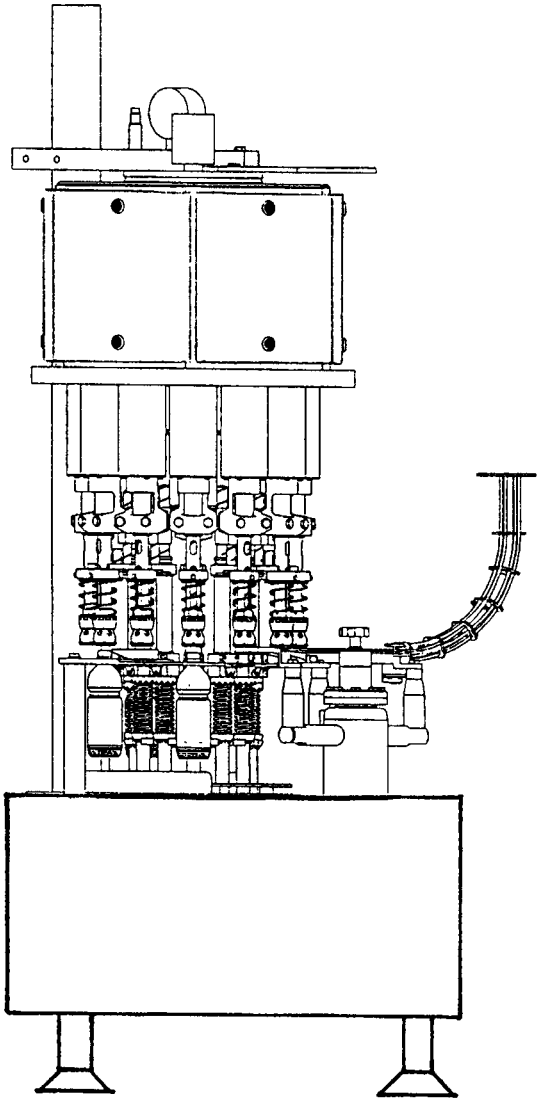
FIG. 3 is a simplified overall view of a closing machine as described by the present application.
Figure 3A:
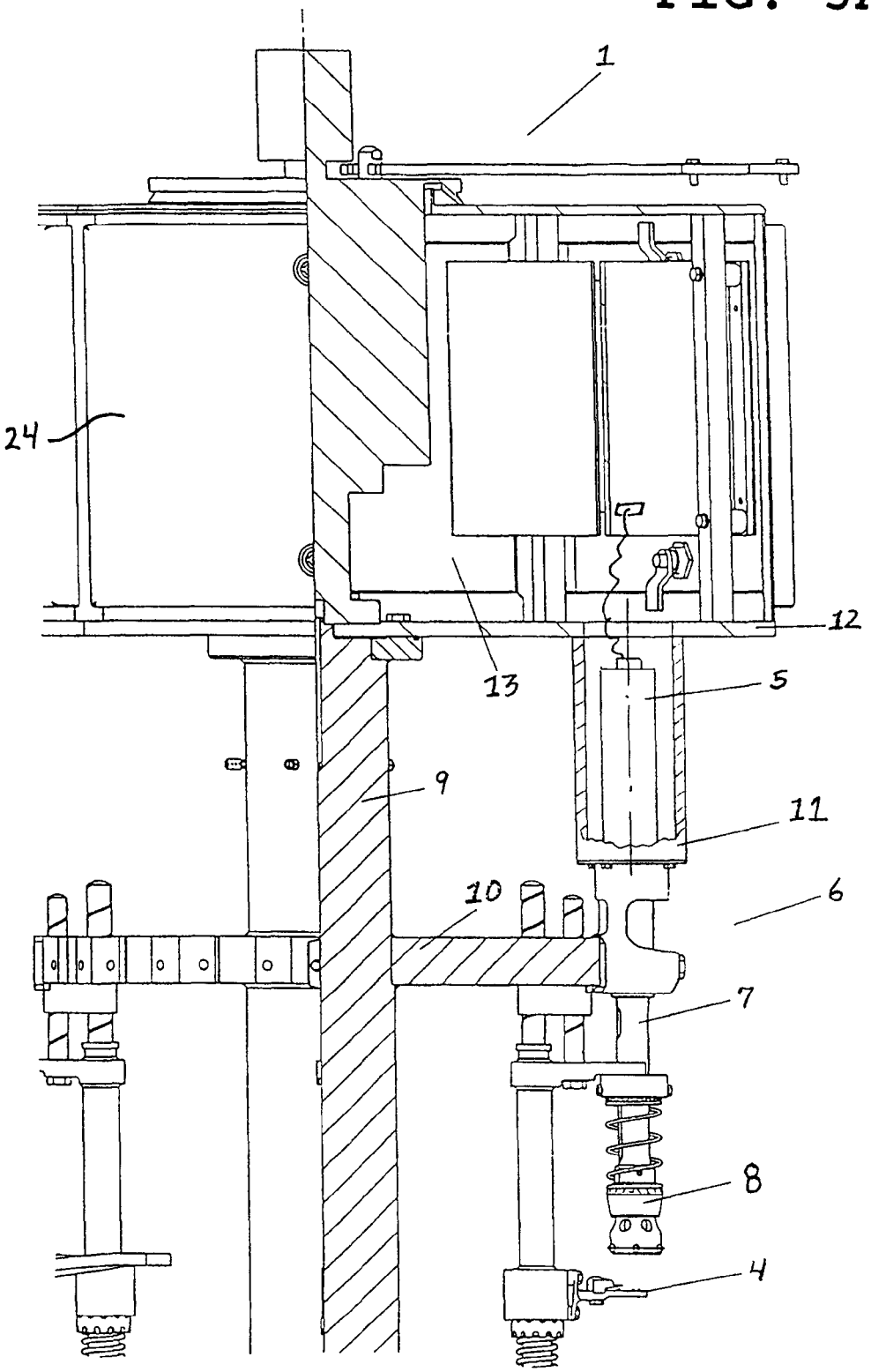
FIG. 3A is similar to FIG. 2, and shows the mounting space is hermetically sealed by doors in one possible embodiment.

FIG. 3A is similar to FIG. 2, and shows a possible embodiment where the mounting space is hermetically sealed with respect to the environment and/or environmental influences by doors 24.

Figure 4:
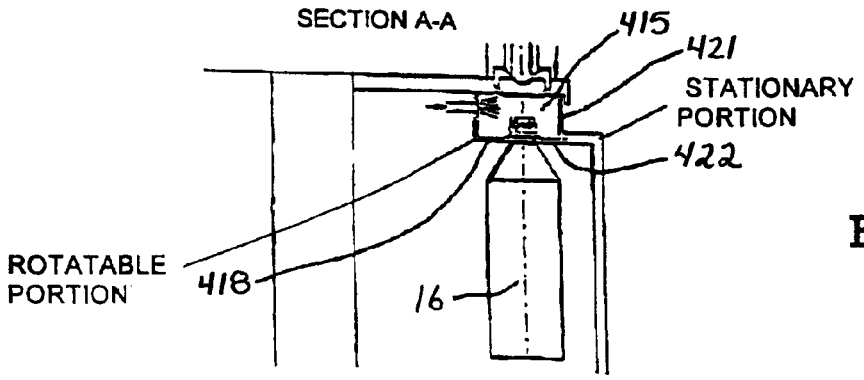
FIG. 4 is a detail illustration of an embodiment of a housing in the region of a filling machine, along line A-A in FIG. 6.

In accordance with another possible embodiment that is illustrated in FIG. 4, the clean chamber comprises a chamber, or a space, or a room 415 that surrounds only a portion of the beverage containers 16, namely, at least the mouth portions 417 thereof. In other words, chamber 415 is generally configured by rotatable portions or components 418 and by stationary portions or components 421. In this, the holders, supports and centering arrangements or centering devices 419 for the bottle mouths 417 are possibly directly disposed at the lower horizontal wall surface 418 that is rotating with the machine carousel. Such elements 419, accordingly, can comprise simple semicircular openings. On the other hand, other embodiments can be provided for the respective purpose. Thus, it is within the scope of the application that at the rotating wall of the chamber there are provided specially configured support fingers, or clamping fingers, and the like that can be accessed in the input regions and in the output regions for holding and for transferring. The outwardly directed centering of the circulating containers, or, respectively, the mouth portions thereof, is assuredly provided by a stationary chamber portion 420. This chamber portion 420 is practically configured rectangularly and it possibly forms a vertically projecting outer wall 421 and the inwardly directed centering wall 422 that can also be provided with a seal for sealing the annular gap. For enhancing cleaning, the centering wall 422 can also be disposed somewhat slopingly. The input region and the output region of such a filling machine are possibly formed by rotating stars.

Figure 4A:
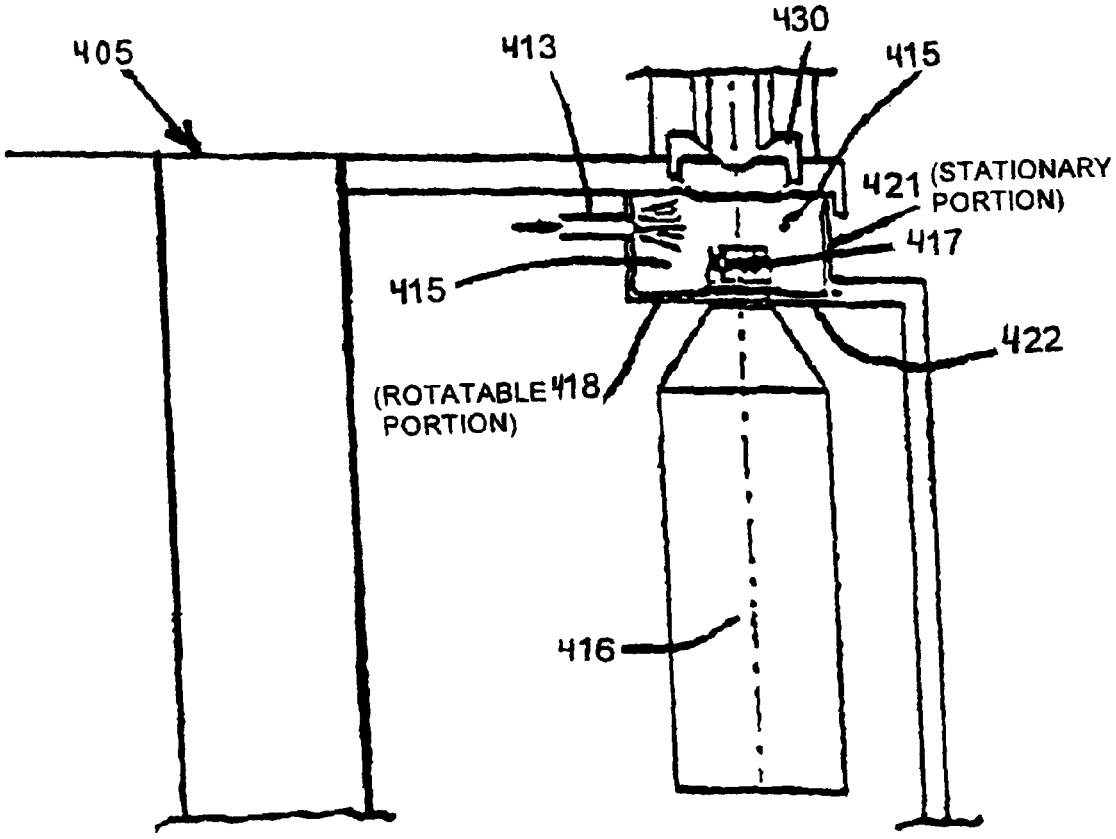
FIG. 4A is a view similar to FIG. 4 drawn to a larger scale and including identification of further detail.

FIG. 4A is a view similar to FIG. 4, but drawn to a larger scale and additionally showing a filling valve 430.

Figure 5:
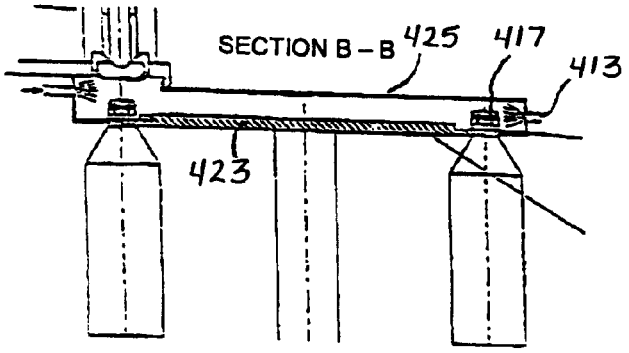
FIG. 5 is a cross-section along line B-B in FIG. 6.
Figure 5A:
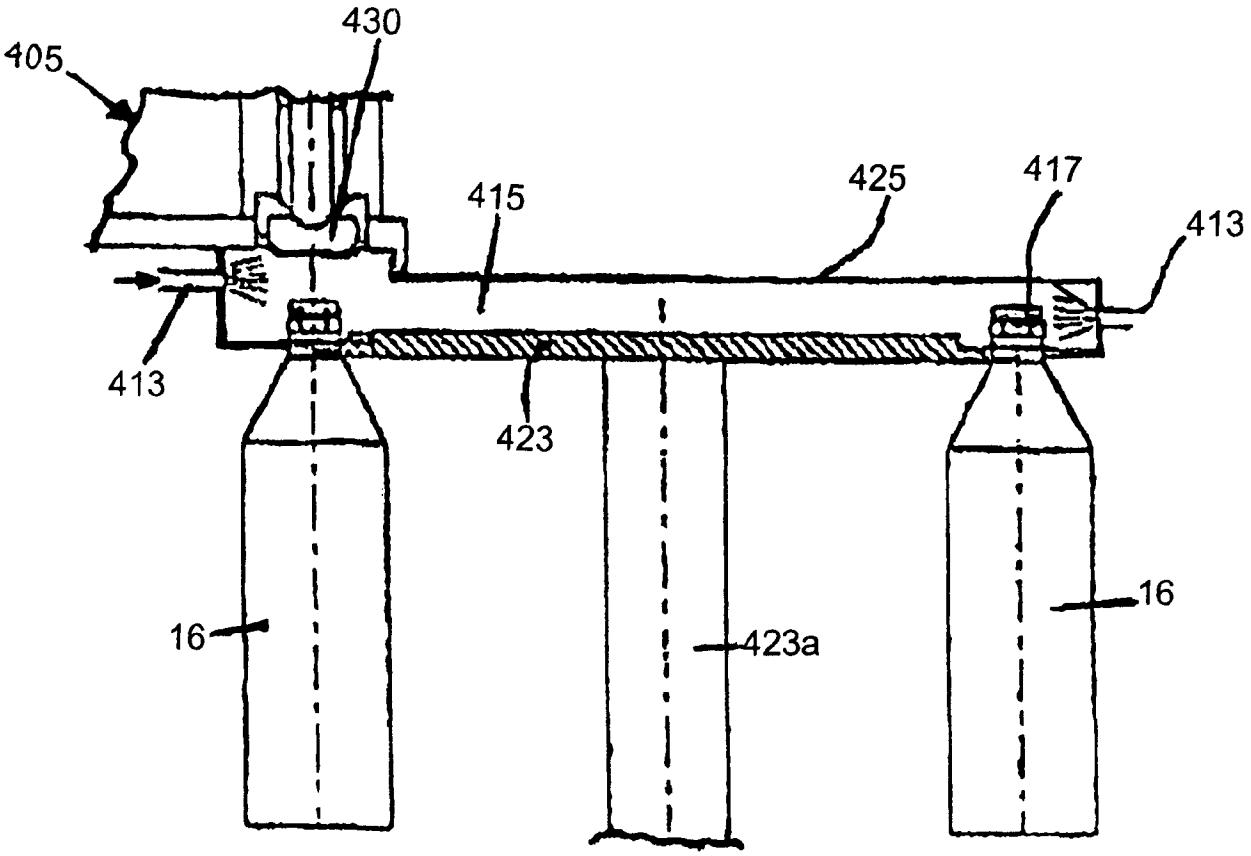
FIG. 5A is a view similar to FIG. 5 drawn to a larger scale and including identification of further detail.

In FIG. 5A, the flat disc 423 is shown to be rotatably disposed by means of a shaft 423*a*. FIG. 5A also indicates a filling valve 430, as is known in the art.

Figure 6:
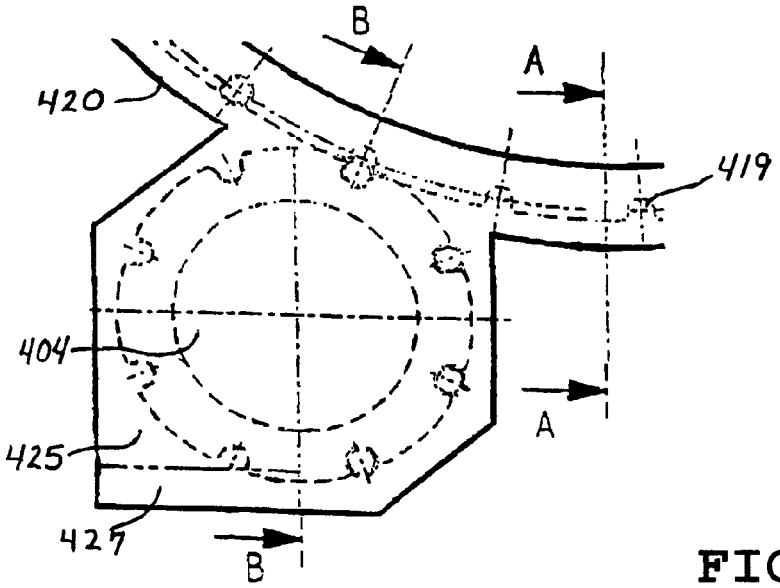
FIG. 6 is a top plan view of the enclosed region of an input star conveyer to feed bottles to a filling machine according to one possible embodiment.

In accordance with the embodiment of FIG. 5 and FIG. 6, the stars are provided by a flat disc 423 with corresponding recesses, supports, and/or centering structures 424. These discs are enveloped by a stationary upper hood component 425 whereby the rotating disc surface provides the lower limit of the chamber. For introduction and removal of the mouth in the transfer region of the filling machine 405, and the like equipment, there can be provided transfer devices, cover sheets 426, and the like transfer elements, or arrangements to move bottle from the star wheel recess 424 to the filling machine recess 419, as is illustrated by way of an input embodiment in FIG. 6.

The container mouths are possibly introduced at a narrow entrance opening and exit opening 427 of the star pockets, or, respectively, the centering devices 424, or, respectively, removed from these upon completion of processing. For introduction of the sterile medium, inlets, or nozzles 413 can be provided at various locations, so as to maintain a rather constant and a rather all-pervasive low over-pressure in the clean chamber 415. However, it is within the scope of the various embodiments to carry out the introduction of the sterile medium at the container input side, whereby this sterile medium, or, respectively, a portion thereof, flows through the clean chamber 415 in the direction of rotation of the equipment while utilizing the rotational flow.

Figure 7A:
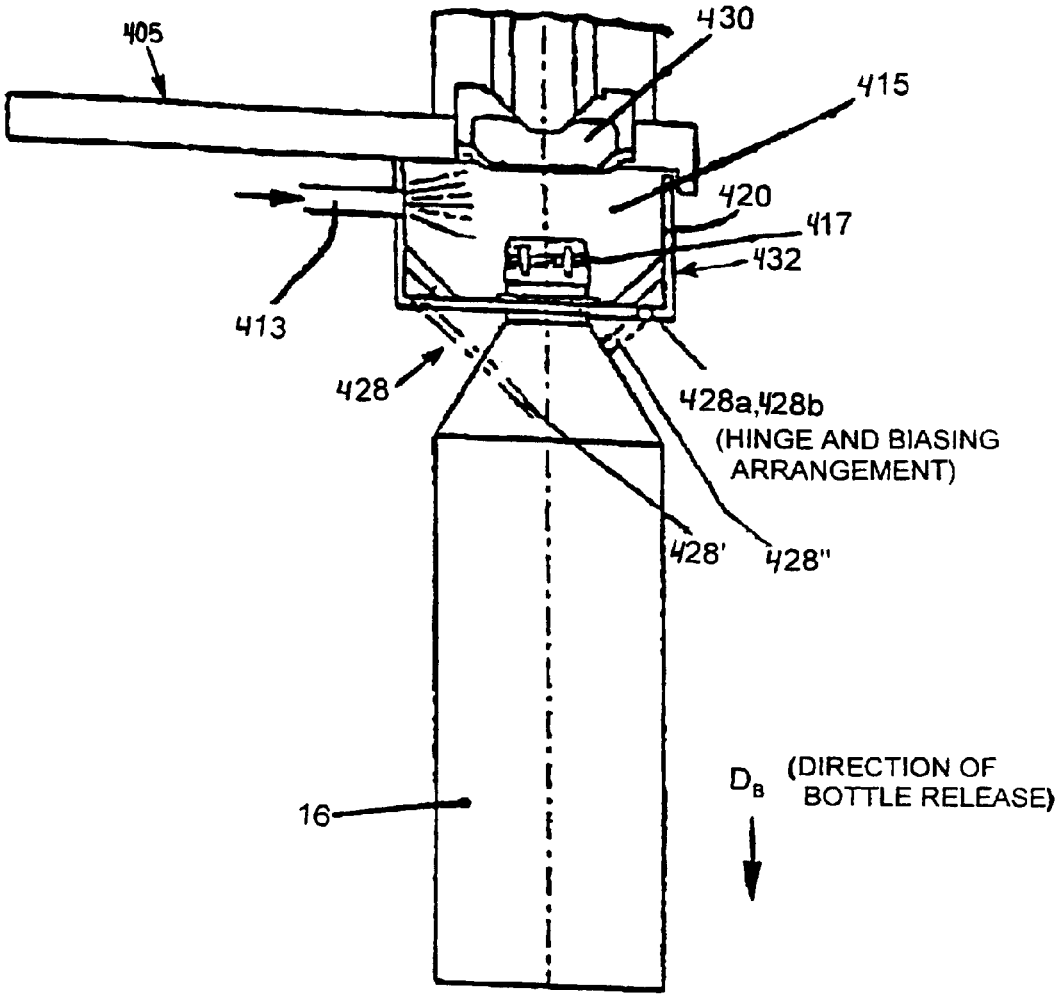
FIG. 7A is a view similar to FIG. 7 drawn to a larger scale and including identification of further detail.

In accordance with another possible embodiment illustrated in FIG. 6, the supports, and/or the centering devices 424 that carry the mouths 417, or, respectively, the regions thereof, can be hingedly disposed, for example, to be swung in outward direction, or in downward direction. For this, the corresponding hinge mechanism 425 can be held with torsion springs 427 at rotary hinges 426. In other words, FIG. 7A suggests a hinge 428*a*, as is well known, and a biasing element, such as, a spring 428*b*, as is well known for spring-biased hinge arrangements, for example, a torsion spring, forming part of a release mechanism or arrangement 428 having components 428' and 428" for bottles 16 that may need to be removed in downward direction $D_B$ upon a operating and/or system failure in the filling process. There may also be provided a stop arrangement 432.

Figure 7B:
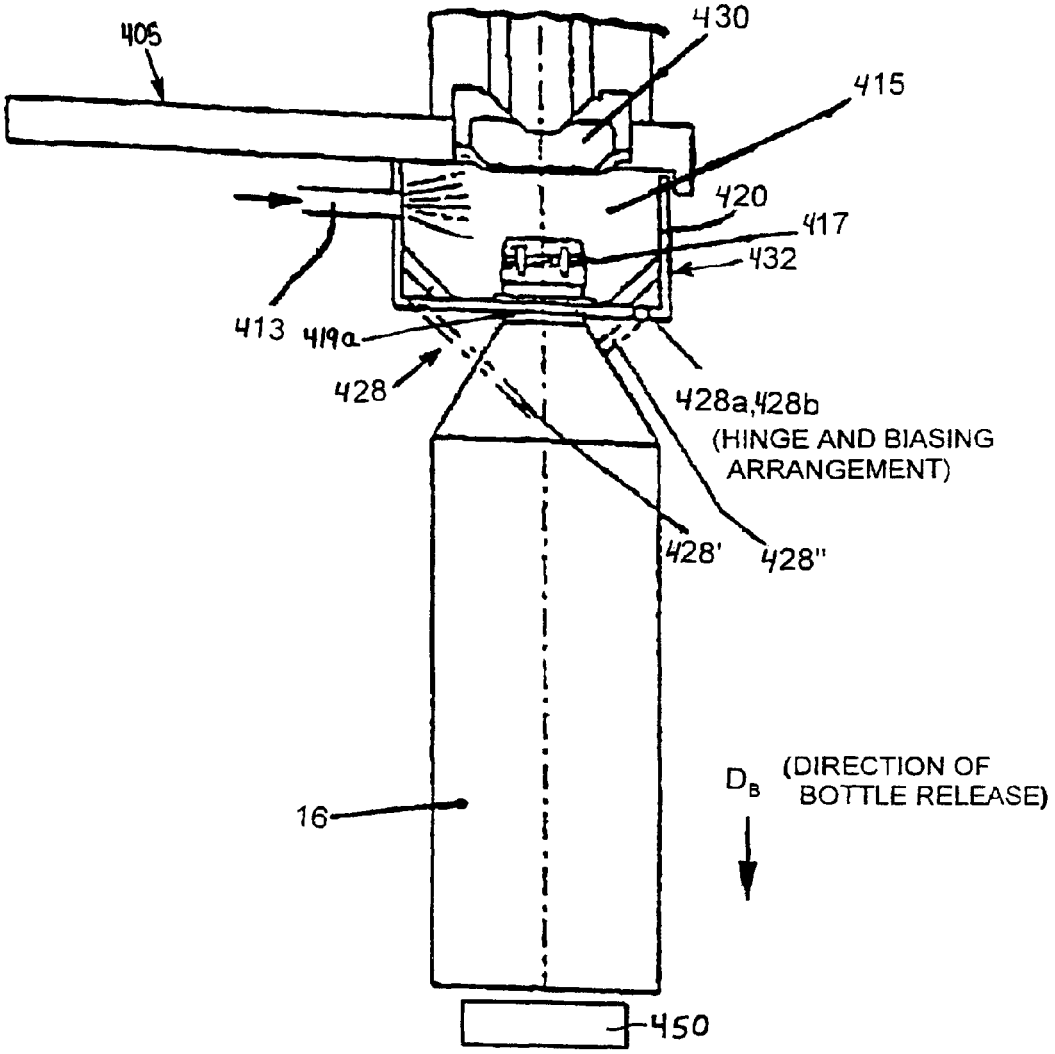
FIG. 7B is a view similar to FIG. 7 and including identification of further detail.

In the case where the containers 16 are introduced from below in upward direction in the manner as is done in known filling machines that employ lifting elements, there are possibly provided openings at the lower side of the clean chamber. Movement of a bottle 16 into the corresponding opening may be with play or without play. Flexible openings or retainers 419*a* and a lifting device 450 are illustrated in FIG. 7B of this application. In this way, the mouth portion 417 of a bottle 16 is introduced from below into the clean chamber 415 and is then surrounded in the chamber 415 by a disinfecting medium.

The bottles 16 may be introduced by lifting devices 450 which are well known in the art, from below into the clean room or chamber 415.

In other words, a container filling machine 405 may possibly of a design of a rotating machine that has a plurality of filling elements or filling valves 430 the rotor 105'. Support plates or support tables that can be raised and lowered at the filling positions 113 are associated with the filling elements or valves 430, which support tables, for example carriers, receive the containers 16 that are to be filled via input star wheels, for example transport star 404 (see FIG. 8).

Further, a lifting device such as 450, that also lowers a container 16, is associated with each of these support tables, has the purpose of raising the containers 16 that are disposed on the support tables or carriers towards the filling devices or valves 430 and to press the containers 16 against the filling valves 430. In order to accomplish this function, these lifting devices may possibly comprise a combination of a fixed piston and a moveably disposed cylinder structure that surrounds the piston. The structural components are disposed vertically, and with the piston being rigidly connected to the rotor of the container filling machine 405. The cylinder can be moved up and down in a vertical direction. The cylinder chamber or cavity that is established between the fixed piston and the moveable cylinder, is in most cases operated by compressed air, the compressed air being passed through a bore within the piston, such that the cylinder is moved in a vertical direction to an upper position. This movement may possibly be limited by a roller that is secured to the cylinder, which roller is configured to rotate about its longitudinal axis, with the roller contacting a curved stationary cam structure. By way of the rotating movement of the rotor of the container filling machine, the roller rolls upon the curved path of the cam structure, that is, it follows the course of the curved cam structure and simultaneously carries out an upwardly directed movement and a corresponding downwardly directed movement, which movements, due to the configuration of the design of the machine 405, are also carried out by the support table and, accordingly, a container 16 supported on a support table.

The curved path of such cam structures is not disposed along the entire circumferential surface area or region of the rotor 105', but they rather extend only along a portion of the circumference, possibly in the region of the container inlet and the container outlet, where the receiving surface of the support table 113*a* needs to be disposed at the level of the transport structures that supply containers 16 and also remove containers 16.

FIG. 8 illustrates a transfer arrangement for transferring bottles from the input star conveyer to the filling machine.

Figure 9:
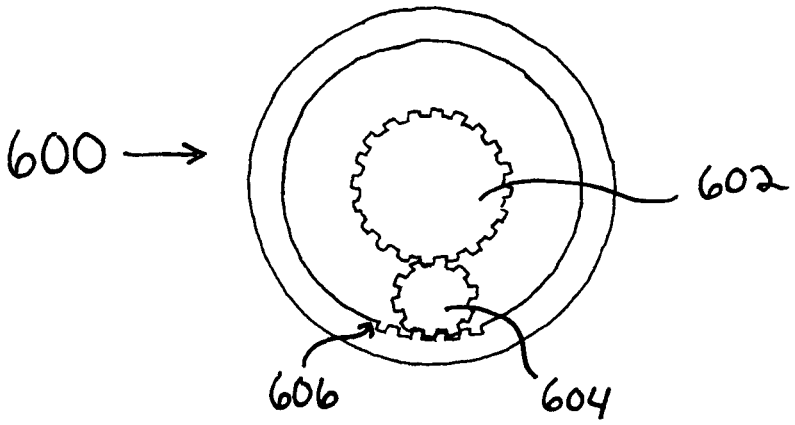
FIG. 9 shows an example of a gear system with a partial internal toothing.

FIG. 9 shows an example of a gear system 600 with a partial internal toothing. The gear system 600 is a standard planetary gear system with a sun gear 602, a planet gear 604, and a ring gear 606 with a partial internal toothing. It is to be understood that the planetary gear system 600 could have more than one planet gear 604 and more than one section of teeth on the interior of the ring gear 606. In at least one possible embodiment of the present invention, the planetary gear system 600 could be used to control the rotation of the screw shaft 7.

One feature or aspect of an embodiment is believed at the time of the filing of this patent application to possibly reside broadly in a beverage bottling plant for filling bottles with a liquid beverage filling material, said beverage bottling plant comprising: a bottle cleaning machine being configured and disposed to clean empty bottles; a feed arrangement to supply empty bottles to said bottle cleaning machine; a beverage filling machine being configured and disposed to fill empty bottles with liquid beverage filling material; said beverage filling machine comprising a plurality of beverage filling devices for filling bottles with liquid beverage filling material; a first conveyer arrangement being configured and disposed to move empty bottles from said bottle cleaning machine into said beverage filling machine; said first conveyer arrangement comprising a star wheel structure; a rotatable bottle closing machine being configured and disposed to close tops of filled bottles by screwing on screw caps or closures; a second conveyer arrangement being configured and disposed to move filled bottles from said rotatable beverage filling machine into said bottle closing machine; said second conveyer arrangement comprising a star wheel structure; and said bottle closing machine comprising: a rotor; a rotatable vertical machine column; said rotor being connected to said vertical machine column to permit rotation of said rotor about said vertical machine column; a plurality of closing devices disposed on the periphery of said rotor; each of said plurality of closing devices comprising: a container carrier being configured and disposed to receive and hold filled bottles; a rotatable screw shaft being configured and disposed to be rotated to screw a screw cap or closure on a filled bottle; said screw shaft comprises a screw head disposed on an end of said screw shaft; said screw head being configured and disposed to pick up and hold a screw cap or closure to be screwed onto a filled bottle; and a drive motor being configured and disposed to rotate said screw shaft; a housing space to house components of said closing station being disposed above said plurality of closing devices; and said housing space being configured and disposed to rotate together with said vertical machine column.

One feature or aspect of an embodiment is believed at the time of the filing of this patent application to possibly reside broadly in a closing machine for closing bottles, jars with a screw cover or similar containers with closures or screw caps by screwing on the closure or cap, with a plurality of closing positions formed on the periphery of a rotor circulating around a vertical machine axis, to which positions the containers to be closed are transferred at a container inlet and the closed containers are removed at a container outlet, whereby each closing position has a container carrier and a screw shaft that is provided on its lower end with a screw head and is mounted so that it can rotate around an axis, whereby each of these screw shafts can be driven by its own drive motor, characterized by the fact that above the closing positions a mounting space is formed which rotates together with the main column.

Another feature or aspect of an embodiment is believed at the time of the filing of this patent application to possibly reside broadly in a closing machine, characterized by the fact that the mounting space is hermetically sealed with respect to the environment and/or environmental influences.

Yet another feature or aspect of an embodiment is believed at the time of the filing of this patent application to possibly reside broadly in a closing machine, characterized by the fact that the mounting space is accessible through hermetically sealed closable openings such as doors and/or lids.

Still another feature or aspect of an embodiment is believed at the time of the filing of this patent application to possibly reside broadly in a closing machine, characterized by the fact that the mounting space contains the drive motors.

A further feature or aspect of an embodiment is believed at the time of the filing of this patent application to possibly reside broadly in a closing machine, characterized by the fact that the mounting space contains at least one rotary distributor for operating current and/or control signals.

Another feature or aspect of an embodiment is believed at the time of the filing of this patent application to possibly reside broadly in a closing machine, characterized by the fact that all the exterior surfaces of the mounting space can be sprayed with cleaning and/or disinfecting agent by nozzles that are stationary and/or rotate with the main column.

Yet another feature or aspect of an embodiment is believed at the time of the filing of this patent application to possibly reside broadly in a closing machine, characterized by the fact that each of the drive motors is located in a separate motor housing that is sealed against environmental influences and is connected with the mounting space.

Still another feature or aspect of an embodiment is believed at the time of the filing of this patent application to possibly reside broadly in a closing machine, characterized by the fact that the closing machine contains means that effect a non-continuous rotation of the screw heads.

A further feature or aspect of an embodiment is believed at the time of the filing of this patent application to possibly reside broadly in a closing machine, characterized by the fact that these means are the drive motors, whereby said motors can be servo motors or stepper motors or synchronous motors.

Another feature or aspect of an embodiment is believed at the time of the filing of this patent application to possibly reside broadly in a closing machine, characterized by the fact that said means are clutches.

Yet another feature or aspect of an embodiment is believed at the time of the filing of this patent application to possibly reside broadly in a closing machine, characterized by the fact that said means are non-rotating partial segments of an internal toothing.

Still another feature or aspect of an embodiment is believed at the time of the filing of this patent application to possibly reside broadly in a method for the operation of a closing machine, characterized by the fact that the screw heads can be driven in rotation only when containers are ready for immediate closing.

A further feature or aspect of an embodiment is believed at the time of the filing of this patent application to possibly reside broadly in a method for the operation of a closing machine, characterized by the fact that the screw heads are driven in rotation only during their acceleration phases of the rotational movements, the actual capping process and the deceleration phases of the rotational movements.

Another feature or aspect of an embodiment is believed at the time of the filing of this patent application to possibly reside broadly in a method for the operation of a closing machine, characterized by the fact that the direction of rotation of the screw heads is at least partly in the direction opposite to its direction of rotation during the screw-on process.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of bottling systems that may possibly be utilized or possibly adapted for use in at least one possible embodiment of the present application may possibly be found in the following U.S. patents, all assigned to the Assignee herein, namely: U.S. Pat. No. 4,911,285; U.S. Pat. No. 4,944,830; U.S. Pat. No. 4,950,350; U.S. Pat. No. 4,976,803; U.S. Pat. No. 4,981,547; U.S. Pat. No. 5,004,518; U.S. Pat. No. 5,017,261; U.S. Pat. No. 5,062,917; U.S. Pat. No. 5,062,918; U.S. Pat. No. 5,075,123; U.S. Pat. No. 5,078,826; U.S. Pat. No. 5,087,317; U.S. Pat. No. 5,110,402; U.S. Pat. No. 5,129,984; U.S. Pat. No. 5,167,755; U.S. Pat. No. 5,174,851; U.S. Pat. No. 5,185,053; U.S. Pat. No. 5,217,538; U.S. Pat. No. 5,227,005; U.S. Pat. No. 5,413,153; U.S. Pat. No. 5,558,138; U.S. Pat. No. 5,634,500; U.S. Pat. No. 5,713,403; U.S. Pat. No. 6,276,113; U.S. Pat. No. 6,213,169; U.S. Pat. No. 6,189,578; U.S. Pat. No. 6,192,946; U.S. Pat. No. 6,374,575; U.S. Pat. No. 6,365,054; U.S. Pat. No. 6,619,016; U.S. Pat. No. 6,474,368; U.S. Pat. No. 6,494,238; U.S. Pat. No. 6,470,922; and U.S. Pat. No. 6,463,964.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of stepping motors that may possibly be utilized or possibly adapted for use in at least one possible embodiment of the present application may possibly be found in the following U.S. patents: U.S. Pat. No. 6,348,774 issued to Andersen et al. on Feb. 19, 2002; U.S. Pat. No. 6,373,209 issued to Gerber et al. on Apr. 16, 2002; U.S. Pat. No. 6,424,061 issued to Fukuda et al. on Jul. 23, 2002; U.S. Pat. No. 6,509,663 issued to Aoun on Jan. 21, 2003; U.S. Pat. No. 6,548,923 to Ohnishi et al. on Apr. 15, 2003; and U.S. Pat. No. 6,661,193 issued to Tsai on Dec. 9, 2003.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

Some examples of sensors that may possibly be utilized or possibly adapted for use in at least one possible embodiment of the present application may possibly be found in the following U.S. patents: U.S. Pat. No. 6,062,248 issued to Boelkins on May 16, 2000; U.S. Pat. No. 6,223,593 issued to Kubisiak et al. on May 1, 2001; U.S. Pat. No. 6,466,035 issued to Nyfors et al. on Oct. 15, 2002; U.S. Pat. No. 6,584,851 issued to Yamagishi et al. on Jul. 1, 2003; U.S. Pat. No. 6,631,638 issued to James et al. on Oct. 14, 2003; and U.S. Pat. No. 6,707,307 issued to McFarlane et al. on Mar. 16, 2004.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of servo-motors that may possibly be utilized or possibly adapted for use in at least one possible embodiment of the present application may possibly be found in the following U.S. patents: U.S. Pat. No. 4,050,434 issued to Zbikowski et al. on Sep. 27, 1977; U.S. Pat. No. 4,365,538 issued to Andoh on Dec. 28, 1982; U.S. Pat. No. 4,550,626 issued to Brouter on Nov. 5, 1985; U.S. Pat. No. 4,760,699 issued to Jacobsen et al. on Aug. 2, 1988; U.S. Pat. No. 5,076,568 issued to de Jong et al. on Dec. 31, 1991; and U.S. Pat. No. 6,025 issued to Yasui on Feb. 15, 2000.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

Some examples of bottling systems which may possibly be utilized or adapted for use in at least one possible embodiment may possibly be found in the following U.S. patents: U.S. Pat. No. 6,684,602, entitled "Compact bottling machine;" U.S. Pat. No. 6,470,922, entitled "Bottling plant for bottling carbonated beverages;" U.S. Pat. No. 6,390,150, entitled "Drive for bottling machine;" U.S. Pat. No. 6,374,575, entitled "Bottling plant and method of operating a bottling plant;" U.S. Pat. No. 6,192,946, entitled "Bottling system;" U.S. Pat. No. 6,185,910, entitled "Method and an apparatus for high-purity bottling of beverages;" U.S. Pat. No. 6,058,985, entitled "Bottling machine with a set-up table and a set-up table for a bottling machine and a set-up table for a bottle handling machine;" U.S. Pat. No. 5,996,322, entitled "In-line bottling plant;" U.S. Pat. No. 5,896,899, entitled "Method and an apparatus for sterile bottling of beverages;" U.S. Pat. No. 5,848,515, entitled "Continuous-cycle sterile bottling plant;" U.S. Pat. No. 5,634,500, entitled "Method for bottling a liquid in bottles or similar containers;" and U.S. Pat. No. 5,425,402, entitled "Bottling system with mass filling and capping arrays."

The corresponding foreign and international patent publication applications, namely, Federal Republic of Germany Patent Application No. 103 52 016.3, filed on Nov. 7, 2003, having inventor Herbert BERNHARD, and DE-OS 103 52 016.3 and DE-PS 103 52 016.3, as well as their published equivalents, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

Some examples of rotary couplings which may be utilized or adapted for use in at least one possible embodiment may possibly be found in the following U.S. patents: U.S. Pat. No. 5,971,020, entitled "Rotary coupling for an article handler;" U.S. Pat. No. 5,954,912, entitled "Rotary coupling;" U.S. Pat. No. 5,931,194, entitled "Rotary coupling for an article handler;" U.S. Pat. No. 5,810,049, entitled "Rotary coupling for an article handler;" U.S. Pat. No. 5,747,386, entitled "Rotary coupling;" U.S. Pat. No. 4,456,287, entitled "Rotary coupling;" U.S. Pat. No. 4,452,591, entitled "Resilient rotary coupling;" U.S. Pat. No. 4,449,739, entitled "Rotary coupling;" and U.S. Pat. No. 4,437,846, entitled "Speed limiting rotary coupling."

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

Some examples of starwheels which may possibly be utilized or adapted for use in at least one possible embodiment may possibly be found in the following U.S. patents: U.S. Pat. No. 5,613,593, entitled "Container handling starwheel;" U.S. Pat. No. 5,029,695, entitled "Improved starwheel;" U.S. Pat. No. 4,124,112, entitled "Odd-shaped container indexing starwheel;" and U.S. Pat. No. 4,084,686, entitled "Starwheel control in a system for conveying containers."

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

Some examples of bottle closing machines which may possibly be utilized or adapted for use in at least one possible embodiment may possibly be found in the following U.S. patents: U.S. Pat. No. 4,389,833, entitled "Bottle closing machine having bottle neck washing arrangement;" U.S. Pat. No. 4,205,502, entitled "Rotary bottle closing machine;" U.S. Pat. No. 6,484,477, entitled "Capping machine for capping and closing containers, and a method for closing containers;" U.S. Pat. No. 6,430,896, entitled "Capping machine;" U.S. Pat. No. 5,918,442, entitled "In-line capping machine;" U.S. Pat. No. 5,400,564, entitled "Capping machine;" and U.S. Pat. No. 5,669,209, entitled "In-line capping machine."

The details in the patents, patent applications and publications may be considered to be incorporable, at applicant's option, into the claims during prosecution as further limitations in the claims to patentably distinguish any amended claims from any applied prior art.

Some examples of centering devices for bottle handling devices which may possibly be utilized or adapted for use in at least one possible embodiment may possibly be found in Federal Republic of Germany Application No. DE P 103 14 634, entitled "Spülbares Huborgan" having inventor Herbert Bernhard, and its U.S. equivalent, having Ser. No. 10/813,657, entitled "A beverage bottling plant for filling bottles with a liquid beverage filling material, and an easily cleaned lifting device in a beverage bottling plant" and filed on Mar. 30, 2004; Federal Republic of Germany Application No. DE P 103 08 156, entitled "Huborgan zum Anpressen von Gefässen an Gefässfüllmaschinen" having inventor Herbert Bernhard, and its U.S. equivalent, Ser. No. 10/786,256, entitled "A beverage bottling plant for filling bottles with a liquid beverage filling material, and a container filling lifting device for pressing containers to container filling machines", filed on Feb. 25, 2004; and Federal Republic of Germany Application No. P 103 26 618.6, filed on Jun. 13, 2003, having inventor Volker TILL, and its U.S. equivalent, Ser. No. 10/865,240, filed on Jun. 10, 2004. The above applications are hereby incorporated by reference as if set forth in their entirety herein.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

Some examples of synchronous motors which may possibly be utilized or adapted for use in at least one possible embodiment may possibly be found in the following U.S. patents: U.S. Pat. No. 6,713,899, entitled "Linear synchronous motor;" U.S. Pat. No. 6,486,581, entitled "Interior permanent magnet synchronous motor;" U.S. Pat. No. 6,424,114, entitled "Synchronous motor;" U.S. Pat. No. 6,388,353, entitled "Elongated permanent magnet synchronous motor;" U.S. Pat. No. 6,329,728, entitled "Cylinder-type linear synchronous motor;" U.S. Pat. No. 6,025,659, entitled "Synchronous motor with movable part having permanent magnets;" U.S. Pat. No. 5,936,322, entitled "Permanent magnet type synchronous motor;" and U.S. Pat. No. 5,448,123, entitled "Electric synchronous motor."

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A closing machine to screw caps onto containers comprising bottles, jars, or similar containers, said closing machine comprising:

a main column and a rotor being mounted on said main column;

a plurality of capping devices being disposed about a periphery of said rotor;

each of said capping devices comprising: a container carrier, a rotatable screw shaft, and a screw head to hold a cap therein;

said screw head being disposed at an end of said screw shaft;

a plurality of drive motors, each being operably connected to a corresponding one of said screw shafts to rotate its screw shaft and thereby screw a cap onto a container;

a housing being disposed above said rotor and said capping devices, and being mounted on said main column;

said main column being rotatable about a vertical machine axis to thereby rotate said rotor and said housing about said vertical machine axis;

said housing being configured to house therein components of said closing machine; and said housing comprising an exterior having a minimized number of surface interruptions to maximize accessibility to the exterior of said housing by a cleaning and/or disinfecting medium during a cleaning and/or disinfecting process, and thereby minimize the time of the cleaning and/or disinfecting process.

2. The closing machine according to claim 1, wherein said housing is hermetically sealed.

3. The closing machine according to claim 2, wherein said drive motors are enclosed within said housing.

4. The closing machine according to claim 3, wherein:

said closing machine comprises at least one rotary distributor configured to provide operating current and/or control signals to said drive motors; and said at least one rotary distributor is enclosed within said housing.

5. The closing machine according to claim 4, wherein said closing machine is configured to rotate said screw shafts intermittently.

6. The closing machine according to claim 5, wherein at least one of (a), (b), and (c):

(a) each of said drive motors comprises one of: a servomotor, a step motor, and a synchronous motor;

(b) said closing machine comprises a clutch arrangement configured to control the rotation of each of said screw shafts; and (c) said closing machine comprises an internal gearing configured to control the rotation of each of said screw shafts.

7. The closing machine according to claim 6, wherein said closing machine comprises a container inlet and a container outlet.

8. The closing machine according to claim 7, wherein said housing comprises hermetically sealed, closable openings, doors, and/or flaps.

9. The closing machine according to claim 8, wherein:

said closing machine comprises a plurality of cleaning and/or disinfecting nozzles configured and disposed to rotate with said column; and said nozzles are configured and disposed to spray cleaning and/or disinfecting medium on the outside surfaces of said housing.

10. The closing machine according to claim 9, wherein:

said closing machine comprises actuator components configured to actuate said drive motors;

said actuator components comprise actuator boards, network components, rotary position transducers, and torque meters; and said actuator components are enclosed within said housing.

11. The closing machine according to claim 10, wherein:

said housing comprises a main housing and a plurality of motor housings connected to and projecting from said main housing; and each of said drive motors is enclosed within a corresponding one of said motor housings.

12. The closing machine according to claim 1, wherein said drive motors are enclosed within said housing.

13. The closing machine according to claim 1, wherein:

said closing machine comprises at least one rotary distributor configured to provide operating current and/or control signals to said drive motors; and said at least one rotary distributor is enclosed within said housing.

14. The closing machine according to claim 1, wherein said closing machine is configured to rotate said screw shafts intermittently.

15. The closing machine according to claim 1, wherein:

said housing comprises top, bottom, and side walls that completely enclose a housing space therein; and the closing machine further comprises a plurality of closing machine components disposed within said housing space and enclosed by said walls of said housing.

* * * * *